United States Patent [19]

Kato

[11] Patent Number: 4,549,683

[45] Date of Patent: Oct. 29, 1985

[54] ROLL FEED APPARATUS

[75] Inventor: Heizaburo Kato, Ichikawa, Japan

[73] Assignee: Sankyo Manufacturing Company, Ltd., Tokyo, Japan

[21] Appl. No.: 519,174

[22] Filed: Aug. 1, 1983

[30] Foreign Application Priority Data

Feb. 22, 1983 [JP] Japan ..... 58-24892[U]
Feb. 22, 1983 [JP] Japan ..... 58-24893[U]

[51] Int. Cl.[4] ..... B65H 17/36; B65H 17/44

[52] U.S. Cl. ..... 226/142; 226/145; 226/146; 226/151; 226/154; 226/160; 226/162

[58] Field of Search ..... 226/160, 154, 152, 153, 226/146, 188, 158, 142, 144, 145, 147, 149, 151, 166, 162; 83/261, 264; 74/68, 69, 96

[56] References Cited

U.S. PATENT DOCUMENTS

| | | | |
|---|---|---|---|
| 438,528 | 10/1890 | Cox | 226/142 |
| 1,342,621 | 6/1920 | Brown | 226/142 |
| 2,946,586 | 7/1960 | Pityo | 226/154 |
| 2,946,588 | 7/1960 | Pityo | 226/154 X |
| 2,957,689 | 10/1960 | Clemente | 226/154 |
| 4,032,056 | 6/1984 | Ito . | |
| 4,033,496 | 7/1977 | Rolfe | 226/188 |
| 4,282,779 | 8/1981 | Kato | 74/822 |
| 4,304,348 | 12/1981 | Kato | 226/152 |
| 4,316,569 | 2/1982 | Gentile | 226/154 X |
| 4,415,108 | 11/1983 | Katoh . | |
| 4,475,678 | 10/1984 | Katoh . | |

FOREIGN PATENT DOCUMENTS

| | | | |
|---|---|---|---|
| 157641 | 8/1903 | Fed. Rep. of Germany . | |
| 358284 | 9/1922 | Fed. Rep. of Germany | 83/261 |
| 1552057 | 1/1970 | Fed. Rep. of Germany . | |
| 2114432 | 9/1972 | Fed. Rep. of Germany . | |
| 551966 | 11/1956 | Italy | 226/154 |
| 55-119642 | 9/1980 | Japan . | |
| 1208160 | 10/1970 | United Kingdom . | |

*Primary Examiner*—Harvey C. Hornsby
*Assistant Examiner*—Scott J. Haugland
*Attorney, Agent, or Firm*—Pollock, Vande Sande & Priddy

[57] ABSTRACT

A roll feed apparatus for feeding a sheet material successively to different working stations. The apparatus includes an oscillation driving device, a main sector roll integrally carried by a main roll shaft and adapted to be oscillatorily driven by the oscillation driving device, and a sub-sector roll integrally carried by a sub-roll shaft extending in parallel with the main roll shaft. The sub-sector roll is adapted to cooperate with the main sector roll in clamping a sheet material therebetween and feeding the same. The apparatus further has a driving connection mechanism for drivingly connecting the main sector roll and the sub-sector roll to each other in such a manner that, when the main sector roll is rotated in one direction by a predetermined angle, the sub-sector roll is rotated in the opposite direction substantially by the same angle as the main sector roll, and a roll release device adapted to cause a relative movement between the main sector roll and the sub-sector roll away from each other when the sector rolls are rotated in the directions opposite to those for feeding the sheet material, thereby to release the sheet material from the clamping force exerted by the sector rolls.

9 Claims, 5 Drawing Figures

ROLL FEED APPARATUS

BACKGROUND OF THE INVENTION

1. Field of the Invention

The present invention relates to a roll feed apparatus for feeding intermittently a sheet-like blank material to a processing station on a step-by-step basis. More particularly, the invention concerns a roll feed apparatus which includes a main roll and a subroll for feeding intermittently a strip-like sheet material to one or more work station such as metallic molds in a selective manner and which is suited to be intercorporated in an automated manufacturing machines or other machine tools.

2. Description of the Prior Art and Related Application

The hitherto known sheet material feeding apparatus of the type described above in which a combination of a one-way clutch and brake or a combination of a rotating cam and cam follower for converting a continuous rotation input to an intermittent rotation output for driving intermittently the feeding roller suffer from many shortcomings. For instance, it is difficult, not to say impossible, to feed a strip-like blank material stepwise by a predetermined quantity with a reasonable accuracy due to backlash in a gear train, a dimensional tolerance involved in implementing the cam and cam follower mechanism. The feeding operation may not be carried out at a high speed because jamming or deformation of the sheet material being stepwise fed will be then possibly involved. Troublesome and time consuming procedures are required for adjusting the feeding apparatus for different sheet materials having different thickness. Further, it has been impossible to vary a quantity of sheet material to be fed through a single feeding step in a stepless manner without interrupting operation of the feeding apparatus as well as associated tool or tools.

In order to obviate various troubles of the conventional apparatus, the present inventors have developed and proposed improved roll feed apparatus one of which is disclosed in Japanese Patent Application Laid-open No. 119642/80 published on Sept. 13, 1980 and corresponding to U.S. Pat. No. 4,304,348. This improved apparatus, however, is not completely satisfactory in that it cannot provide sufficiently high precision of operation particularly when the operation speed is high, although it can eliminate the above-described problems of the prior art.

The present inventors have worked out, through an intense study, a roll feed apparatus having a sector-shaped main roll, i.e. a main sector roll, and a sector-shaped subroll, i.e. a sub-sector roll, the main sector roll and the sub-sector roll being driven oscillatorily in such a manner that, when they rotate in one direction, they clamp the sheet therebetween and feed the same forwardly, while, when they rotate in the opposite direction, they release the sheet. This type of roll feed apparatus is shown in the specification of now U.S. patent application Ser. No. 435,800. The use of the sector rolls decreases the inertia in the driving of the rolls and to enhance the precision of the feed of the sheet.

This roll feed apparatus incorporating sector gears, however, involves the following problems. Namely, the precision of the feed may be impaired undesirably due to the presence of a backlash in a pair of gears through which the rolls are connected drivingly. Another problem is that this apparatus necessitates an expensive and heavy coupling for moving two rolls towards and away from each other to effect the clamp and release of the sheet, while drivingly connecting two gears trhough a pair of gears mentioned above.

SUMMARY OF THE INVENTION

An object of the invention is to provide a roll feed apparatus which is capable of feeding a strip-like sheet material intermittently by a predetermined amount with an enhanced accuracy even in a high speed operation without involving jamming, deformation or the like undesirable effect.

Another object of the invention is to provide a roll feed apparatus employing a simple arrangement for effecting both of driving of two rolls and relative movement of the rolls towards and away from each other.

A further object of the invention is to provide a sheet material feeding apparatus of the type described, in which the quantity of sheet material to be fed through a single feeding step can be varied in a stepless manner without requiring interruption in operation of the feeding apparatus.

To these ends, according to the invention, there is provided a roll feed apparatus comprising: an oscillation driving device; a main sector roll integrally carried by a main roll shaft and adapted to be oscillatorily driven by the oscillation driving device; a sub-sector roll integrally carried by a subroll shaft extending in parallel with the main roll shaft, the sub-sector roll being adapted to cooperate with the main sector roll in clamping a sheet material therebetween and feeding the same; a driving connection mechanism for drivingly connecting the main sector roll and the sub-sector roll to each other in such a manner that, when the main sector roll is rotated in one direction by a predetermined angle, the sub-sector roll is rotated in the opposite direction substantially by the same angle as the main sector roll; and a roll release device adapted to cause a relative movement between the main sector roll and the sub-sector roll away from each other when the sector rolls are rotated in the directions opposite to those for feeding the sheet material thereby to release the sheet material from the camping force exerted by the sector rolls; wherein the driving connection device includes a first oscillation arm mounted on the portion of the main roll shaft outside the main sector roll and adapted to be driven by the oscillation driving device to oscillate as a unit with the main roll shaft and the main sector roll, a second oscillation arm mounted on the portion of the sub-roll shaft outside the sub-sector roll and positioned substantially in the same plane as the first oscillation arm, a guide member disposed near the point of intersection between the plane and the path of feed of the path of feed of the sheet material and provided with a guide groove extending in the direction of feed of the sheet material, a slider slidable in the guide groove, and a first link and a second link connecting the slider to the first and second oscillation arms, respectively, the first and second links being arranged substantially in symmetry with each other with respect to the plane of path of feed of the sheet material, at such an inclination to the plane as to form a shape like V having an apex located at the position of the slider.

The above and other objects, novel features and advantages of the invention will become more clear from the following description of the preferred embodiments taken in conjunction with the accompanying drawings.

DESCRIPTION OF THE PREFERRED EMBODIMENT

Figure 1:
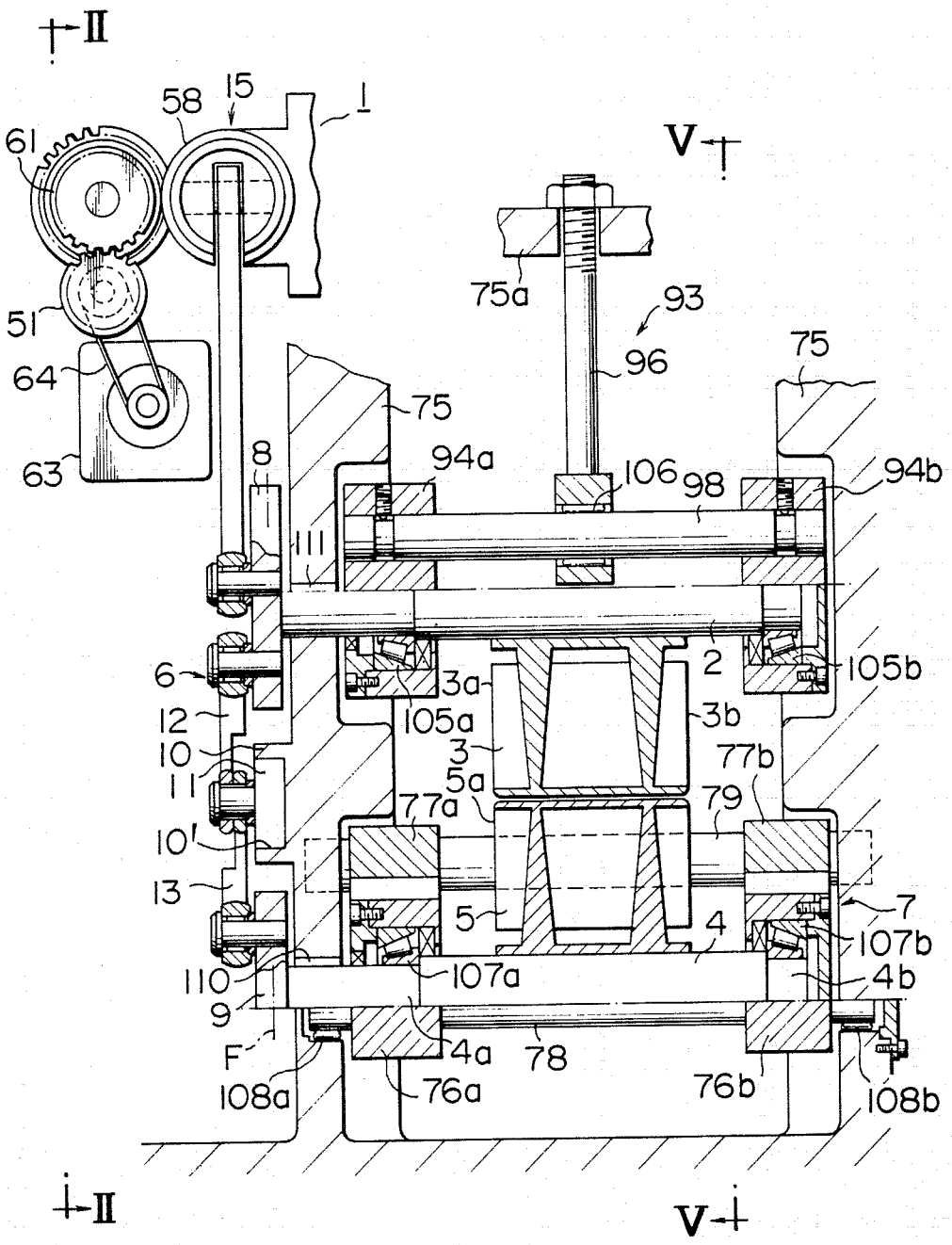
FIG. 1 is a schematic front elevational view of the whole part of an embodiment of the roll feed apparatus in accordance with the invention.
Figure 2:
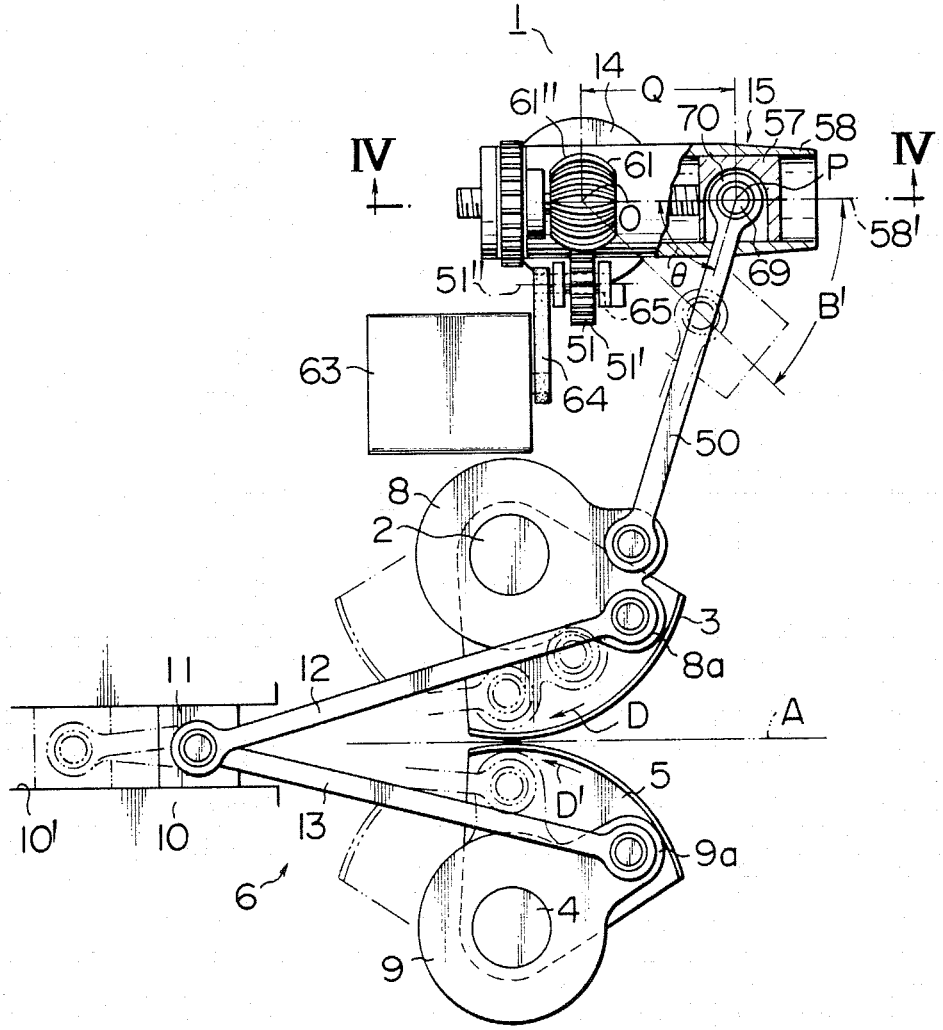
FIG. 2 is a view taken in the direction of arrows II—II in FIG. 1, showing how an oscillation angle altering device, main sector roll, sub-sector roll and driving connection device are arranged in relation to one another.

Referring first to FIGS. 1 and 2, a roll feed apparatus embodying the present invention has an oscillatory driving device 1, a main sector roll 3 integrally carried by a main roll shaft 2, a sub-sector roll 5 integrally carried by a sub-roll shaft 4 and adapted to cooperate with the main sector roll in clamping and feeding a sheet material, a driving connection device for drivingly connecting the main sector roll and the sub-sector roll 6 and a roll release device 7 which will be explained later with reference to FIGS. 1 to 5.

The driving connection device 6 incorporated in the illustrated embodiment is constituted by the following parts: namely, a first oscillation arm 8 mounted on a portion of the main roll shaft 2 outside the main sector roll 3 and, more specifically, on the portion of the main roll shaft 2 extending leftwardly beyond the left end surface 3*a* (see FIG. 1) of the main sector roll 3; a second oscillation arm 9 mounted on the portion of the sub-roll shaft 4 outside the sub-sector roll 5 and, more specifically, on the portion of the sub-roll shaft extending leftwardly beyond the left end 5*a* (see FIG. 1) and positioned substantially in the same plane (F) as the first oscillation arm 8; a guide member 10 having a guide groove 10'; a slider 11 slidable within the groove 10'; and a link mechanism having a first link 12 and a second link 13. The guide groove 10' is positioned near the point of intersection between the above-mentioned plane F and the path A of the sheet and extends in the direction of feed of the sheet, so that the slider 11 is slidingly moved along the guide groove 10' in the direction of feed of the sheet and in the direction opposite to the feed of the sheet. The first link 12 connects the slider 11 to a right lower projection 8*a* (see FIG. 2) of the first oscillation arm 8, while the second link 13 provides a connection between the slider 11 and the right lower projection 9*a* (see FIG. 2) of the second oscillation arm 9. The first and second arms 12 and 13 are extended at an inclination substantially in symmetry with respect to the plane including the path A of the sheet to form a substantially V-like form having an apex located at the position of the slider 11.

The driving connection device 6 drivingly connects both sector rolls to each other such that, when the main sector roll 3 is oscillatorily rotated in one direction, clockwise or counter-clockwise, the sub-sector roll 5 is oscillatorily rotated in the opposite direction substantially by the same angle. For instance, referring to FIG. 2, when the main roll shaft 2, first oscillation arm 8 and the main sector roll 3 are rotated clockwise as a unit by a predetermined angle, the slider 11 slides to the left along the guide groove 10' through the action of the first link 12 and, at the same time, the second oscillation arm 9, sub-roll shaft 4 and the sub-sector roll 5 as a unit are oscillatorily rotated in the counter-clockwise direction substantially by the same angle as the rotation of the main sector roll 3 through the action of the second link 13. The positions of the parts after the rotation are shown by chain line in FIG. 2. Similarly, when the main roll shaft 2, first oscillation arm 8 and the main sector roll 3 as a unit are rotated counter-clockwise from the position shown by chain line to the position shown by full line in FIG. 2, the second oscillation arm 9, sub-roll shaft 4 and the sub-sector roll 5 are oscillated clockwise substantially by the same angle as the rotation of the main sector roll 3 to resume the positions shown by full line, through the action of the first link 12, slider 11 and the second link 13.

The driving connection between two sector rolls attained by the driving connection device 6 can be realized at a high precision, by suitably selecting the sizes and positional relationship of the first oscillation arm 8, second oscillation arm 9, first link 12 and the second link 13, taking into account the diameters of both sector rolls and offset between two sector rolls, as will be explained hereinunder with specific reference to FIG. 3.

Figure 3:
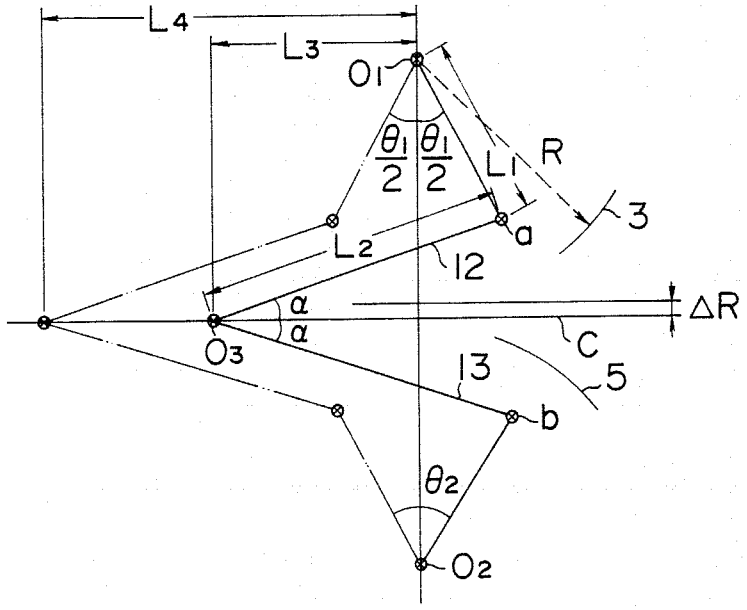
FIG. 3 is a schematic illustration showing the relationship between the sizes of every parts of the driving connection device and the precision of operation in the roll feed apparatus shown in FIG. 2.

FIG. 3 schematically shows the driving connection device 6 shown in FIG. 2. Parameters employed in this Figure represent the following items.

R: radius of the sector rolls 3 and 5

$L_1$: The distance between the point (a) at which the first oscillating arm is connected to the first link 12 and the axis ($O_1$) of the main roll, and the distance between the point (b) at which the second oscillation arm is connected to the second link 13 and the axis ($O_2$) of the sub-roll.

$L_2$: length of first and second link $\Delta R$: amount of offset between two sector rolls $\theta_1$: oscillation angle of main sector roll $\theta_2$: oscillation angle of sub-sector roll $L_3$: vertical distance of the line between the axes $O_1$ and $O_2$ of both sector rolls from the point $O_3$ of connection between two links.

$L_4$: the vertical distance of the line between the axes $O_1$ and $O_2$ of both sector rolls from the point of connection between two links, when the main sector roll and the sub-sector roll have been oscillatorily rotated by predetermined angles $\theta_1$ and $\theta_2$ while the driving connection device has been moved to the position shown by chain line in FIG. 2.

In the state shown in FIG. 3, the point $O_3$of connection between the first link 12 and the second link 13 is located on the horizontal extension of the lower face (C) of the path of movement of the sheet material and, at the same time, first and second links are disposed at both sides of the extension plane at an inclination $\alpha$ in symmetry with respect to the extension plane.

In the arrangement shown in FIG. 3, the relationship between the angle $\theta_1$ of oscillation of the main sector roll 3 and the angle $\theta_2$ of oscillation of the sub-sector roll 5 is represented by the following formula (1)

$$\theta_2=\theta_1-\Delta\theta \quad (1)$$

In the formula (1) above, the symbol $\theta$ represents the rotational error attributable to the offset amount R. As will be understood from this formula (1), in the arrangement shown in FIG. 3, the precision of feed of the sheet material is impaired due to the rotational error $\theta$ attributable to the presence of the offset R. Namely, the length X of feed of the sheet material caused by the rotation of the main sector roll 3 by the angle $\theta$ and the length X' of feed of the sheet material caused by the rotation of the sub-sector roll 5 by the angle $\theta_2$ are given by the following formulae (2) and (3).

$$X=\frac{2\pi R\theta_1}{360} \quad (2)$$

$$X'=\frac{2\pi R\theta_2}{360} \quad (3)$$

The precision of feed of the sheet material can be expressed by the difference between the feed lengths X and X', i.e. by X-X'. In usual roll feed apparatus having a high precision, the above-mentioned precision of feed is on the order of 3/100 mm. Therefore, assuming that the parameter R in FIG. 3 takes a value of 80 mm, $L_1$ takes a value of 70 mm, R takes a value of 1 mm, $L_2$ takes a value of 100 mm and $\theta_1$ takes a value of 60°, the rotation angle $\theta_2$ of the sub-sector roll 5 and the feed lengths X and X' are represented as follows.

$$\theta_2=\cos^{-1}\frac{R}{\sqrt{R^2+L_4^2}}-\cos^{-1}\frac{L_1^2\div L_4^2\div R^2-L_2^2}{2L_1\sqrt{R^2+L_4^2}}+$$

$$\cos^{-1}\frac{L_1^2\div L_3^2\div R^2-L_2^2}{2L_1\sqrt{R^2+L_3^2}}-\cos^{-1}\frac{R}{\sqrt{R^2+L_3^2}}\approx 59.96$$

$$X=\frac{2\cdot\pi\cdot 80\cdot 60}{360}\approx 83.77$$

$$X'=\frac{2\cdot\pi\cdot 80\cdot 59\cdot 96}{360}\approx 83.72$$

Therefore, the precision of feed (X-X') is calculated to be 5/100 mm which compares well with the aforementioned feed precision (3/100 mm) attained in the aforementioned roll feed apparatus having high precision. Thus, it is possible to attain a sufficiently high precision of the feed by suitably selecting the values of the parameters shown in FIG. 3.

The oscillation driving device 1 is a known one such as those disclosed in the specifications of U.S. Pat. Nos. 4,304,348 and 4,282,779. This device has a continuously driven input shaft (not shown) carrying three-dimensional cams (not shown) and three turrets engaging with respective three-dimensional cams to make oscillatory motions corresponding to the countours of these cams. FIG. 2 shows only one 14 of these three turrets. It will be seen that the turret 14 is connected through a connecting shaft 47 (see FIG. 4) to the oscillation angle changing device 15. Although not shown, other two turrets are connected to the first oscillation shaft 16 and the second oscillation shaft 17, respectively, to cause oscillatory motions of these shafts 16 and 17 at a timing which will be explained later.

Figure 4:
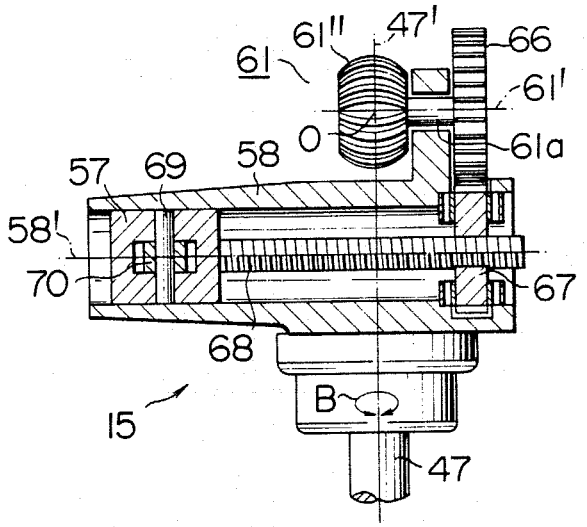
FIG. 4 is a sectional view taken along the line IV—IV of FIG. 2.

As will be clearly understood from FIGS. 2 and 4, the oscillation angle changing device 15 has an oscillation member 58 extending substantially at a right angle to the connecting shaft 47 (see FIG. 4) and unitarily connected at one end to the connecting shaft 47, a slider 57 accomodated by the oscillation member 58, a connecting rod 50 through which the first oscillation arm 8 on the main roll shaft 2 is connected to the slider 57, a crown gear 61 attached to the oscillation member 58, and a spur gear 51 rotatably mounted on the housing of the intermittent driving device 1 and meshing with the crown gear 61. The crown gear 61 is adapted to oscillate as indicated at B' together with the oscillation member 58 when the connecting shaft 47 oscillates as at B together with the turret 14. The crown gear 61 is rotatable around the axis 61' which extends in a plane containing the axis 47' of the connecting shaft and the axis 58' of the oscillation member 58, i.e. perpendicularly to the axis 47' of the connecting shaft as viewed in the plane of FIG. 4. The crown gear 61 has a multiplicity of gear teeth 61'' formed on a spherical surface centered at the point 0 of intersection of the axis 47' of the connecting shaft and the rotation axis 61' thereof. Each tooth 61'' extends in an arcuate form along the rotation axis 61' and meshes with teeth 51' of the spur gear 51 extending in the same direction. Namely, when the crown gear 61 is oscillated as at B' around the axis 47' of the connecting shaft, the arcuate teeth 61'' move arcuately with respect to the spur gear 51', i.e. in the direction of oscillation. In addition when the spur gear 51 is rotated around its axis 51'', the crown gear 61 is rotated around the axis 61' of rotation. Referring to FIGS. 1 and 2, a driving motor is drivingly connected through a timing belt 64 to the shaft 65 of the spur gear 51 thereby to drive the latter.

A driving gear 66 is connected to the rightside end (see FIG. 4) of the driving shaft **61*a* of the crown gear 61. An idle gear 67 engages with the driving gear 66. The idle gear 67 is screwed to the right end of a screw rod 68 provided in the oscillation member 58. The screw rod 68 is fixed at its one end to the slider 57. Therefore, as the motor 63 is driven to rotate the spur gear 51 and, hence, to rotate the crown gear 61 as a unit with the shaft 61*a* around the axis 61', the idle gear 67 is rotated through the driving gear 66 so that the screw rod 68 and the slider 57 as a unit are slided in the axial direction of the oscillation member 58. It is possible to vary, by sliding the slider 57 in a manner explained above, the oscillation angle of the first oscillation arm 8 with respect to the oscillation angle of the oscillation member 58, i.e. the oscillation angle of the main sector roll 3 with respect to the oscillation member 58**.

As will be clearly understood from FIG. 4, the oscillation member 58 oscillates as at B around the axis 47' the position of which coincides with the point O in FIG. 2. The sliding of the slider 57 causes a change in the distance Q between the point P (see FIG. 2) of connection of the oscillation member 58 and the connecting rod 50 to each other and the above-mentioned point 0. The change in the distance Q in turn causes a change in the angle $\theta$ of the connecting rod 50 with respect to the axis 58'. Therefore, an oscillatory rotation of the oscillation member 58 by a predetermined angle causes a change in the oscillation angle of the first oscillation arm 8 and, at the same time, a change in the oscillation angle of the main roll shaft 2 and the main sector roll 3. As explained before, the first oscillation arm 8 is connected to the second oscillation arm 9 through the first link 12, slider 11 and the second link 13. Therefore, the above-mentioned change in the oscillation angle of the first oscillation arm 8 causes a change in the oscillation angle of the second oscillation arm 9, so that the main sector roll 3 and the sub-sector roll 5 oscillate substantially by an equal amount. Thus, by varying the oscillation angle of tha main sector roll 3 and the sub-sector roll 5 with respect to the oscillation angle of the connecting shaft 47 and the oscillation member 58 integral therewith, it is possible to vary the amount of feed of the sheet material in each of the repetitional intermittent feed operation of the roll feed apparatus.

In FIGS. 2 and 4, reference numerals 69 and 70 designate, respectively, a fixing pin provided on the slider 57 and a bearing member rotatably fitted to the pin. The slider 57 and the connecting rod 50 are connected to each other through the fixing pin 69 and the bearing member 70. Similar arrangements are employed in the connections between the connecting rod 50 and the first oscillation arm 8, between the first oscillation arm 8 and the first link 12, and between the first link 12 and the second link 13 through the slider 11.

As will be clearly understood from the foregoing description, the main sector roll 3 and the sub-sector roll 5 are operatively connected to each other through the main sector roll is oscillated in one direction by a predetermined angle, the sub-sector roll is oscillated in the opposite direction substantially by the same angle. Referring to FIG. 2, assume here that the main sector roll 3 is oscillated in the clockwise direction D as viewed in FIG. 2 while the sub-sector roll 5 is oscillated in the counter-clockwise direction D', the sheet material is fed to the left by an amount corresponding to the oscillation angle of both sector rolls. The directions D and D' will be referred to as the "feeding direction", hereinunder. The main sector roll and the sub-sector roll are adapted to make oscillatory motion. The arrangement, therefore, must be such that the main sector roll 3 and the sub-sector roll 5 get away from each other to unclamp the sheet material, as the main sector roll 3 and the sub-sector roll 5 oscillate counter-clockwise and clockwise, respectively, (these directions will be referred to as "counter feeding direction"), for otherwise the sheet material will be returned to the right during the oscillations of the sector rolls 3 and 5 in the counter feeding directions.

It is the roll release device 7 that moves the sector rolls away from each other when the sector rolls oscillate in the counter feeding directions. The construction of the roll release device 7 will be explained hereinunder with reference to FIGS. 1 and 5.

The roll release device 7 in the illustrated embodiment is constructed as a release/brake device which has a function to brake the sheet material to prevent the same from moving in the feeding direction by the inertia after the unclamping, in addition to the above-mentioned function to move the sector rolls 3 and 5 away from each other.

Figure 5:
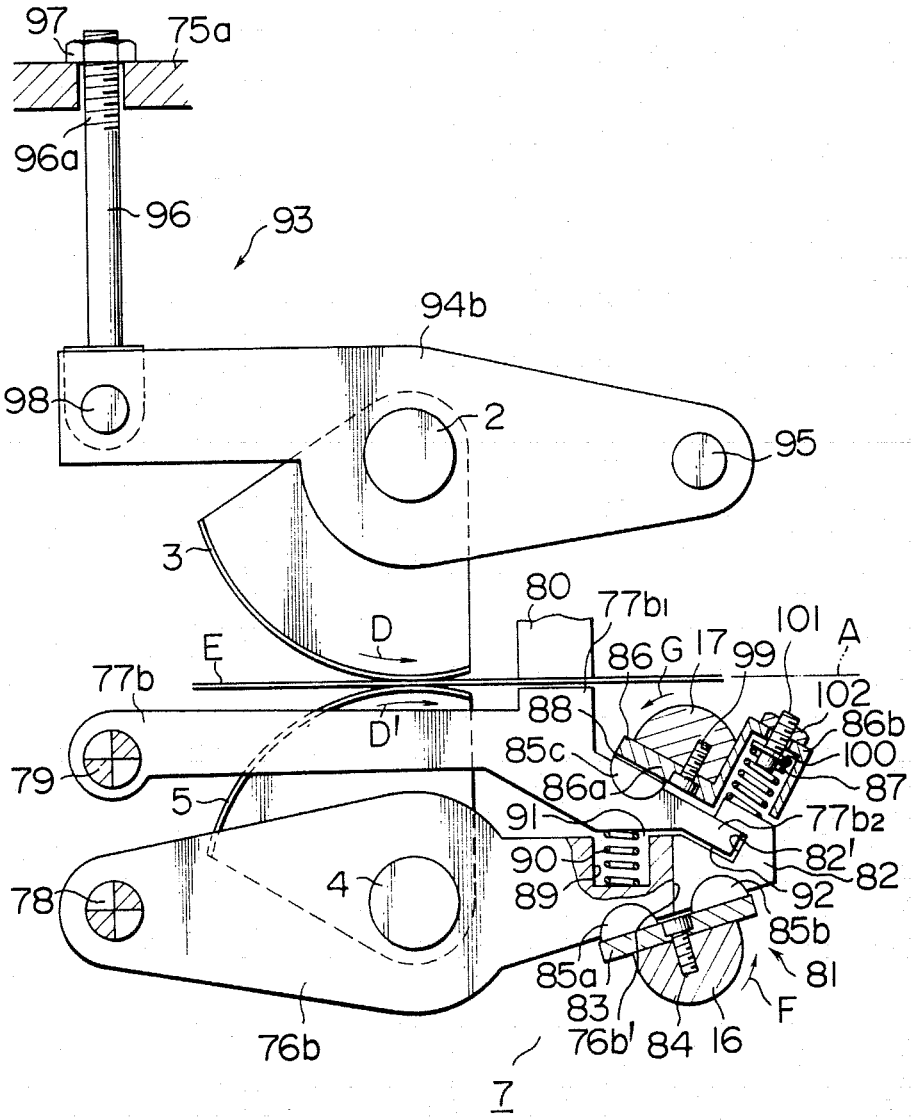
FIG. 5 is a view taken in the direction of arrows V—V in FIG. 1, illustrating a roll release device and a mechanism for adjusting the roll gap between both sector rolls.

More specifically, the roll release device 7 has, as shown in FIG. 5, a pair of release arms 76*a* and 76*b* rotatably carried through bearings 107*a*, 107*b*by portions 4*a* and 4*b* (see FIG. 1) of the sub-roll shaft 4 extending beyond both axial end surfaces of the subsector roll 5, and a pair of brake arms 77*a* and 77*b* disposed between respective release arms 76*a*, 76*b* and the path A of movement of the sheet material and extending in the direction of the path A of feed of the sheet material. As will be clearly understood from FIG. 5, one end (left end as viewed in FIG. 5) of one 76*b* of the release arms fits on a release pivot shaft 78 which extends from the housing 75 (see FIG. 1) of the roll feed apparatus substantially in parallel with the sub-roll shaft 4. Similarly, one end of the other release arm 76*a* fits on the same release pivot shaft 78. The release pivot shaft 78*a* is rotatably mounted at its both ends through needle bearings 108*a* and 108*b* in the housing 95. As will be clearly seen from FIGS. 1 and 5, one ends (left ends as viewed in FIG. 5) of the brake arms 77*a* and 77*b*adjacent to the release pivot shaft 78 fit on a common brake pivot shaft 79 which extends from the housing 75 substantially in parallel with the roll shaft 4. Although not shown in FIG. 1, both ends of the brake pivot shaft 79 are rotatably mounted in the housing 75 through needle bearings as in the case of the release pivot shaft 78. The brake arm 77*b* is provided at its portion slightly spaced rightwardly from both sector rolls as viewed in FIG. 5 with a movable brake pad projected towards the path A of the sheet material. A similar brake pad (not shown) is projected from the brake arm 77*a*. These brake pads extend at a right angle to the plane of FIG. 5 so as to cooperate with stationary brake pads 80 opposing to the movable brake pads across the path A of the sheet material in making fixing and releasing of the sheet material E.

As shown in FIG. 5, the end of the release arm 76*b* remote from the release pivot shaft 78, i.e. the right end as viewed in FIG. 5, and the end of the brake arm 77*b* remote from the brake pivot shaft 79, i.e. the right end as viewed in FIG. 5, are operatively connected to an arm actuator device 81. The arm actuator device 81 has an arm connector 82 slidingly engaging with the right end surface 76*b*' of the release arm 76*b* and provided with a groove 82' loosely engaging with a projection 77*b*2 extending rightwardly downwardly from the right end of the brake arm 77*b*. The arm actuator device 81 further has the first and second oscillation shafts 16 and 17 oscillatorily driven by the oscillatory driving device 1 (see FIGS. 1 and 2) mentioned before. A tabular oscillation plate 83 is secured by means of a bolt 84 to an upper portion of the first oscillation shaft 16. The upper surface of the operation plate 83 engages with flat bottom surfaces of semi-cylindrical coupling members 85*a* and 85*b* rotatably received by semicylindrical recesses formed in the lower surface of the right end of the release arm 76*b* and in the lower surface of the arm connecting member, respectively. An operation member 86 has a tabular part 86*a* and a housing part 86*b* which is formed at the right side of the tabular part 86*a* and housing a second spring 87. The operation member 86 is secured to the lower side of the second oscillation shaft 17 by means of a bolt 99. The lower surface of the tabular portion 86*a*opposes, across a third gap 88, to the flat upper surface of the semicylindrical coupling member 85*c* which is rotatably received by a semi-cylindrical recess formed in the right upper surface of the brake arm 77*b*.

The release arm 76*b* is provided in its right end portion with an upwardly opening recess 89 which receives a first spring 90. The upper end of the first spring 90 received by the recess abuts the lower surface of the brake arm 77*b* to urge the brake arm 77*b* and the release arm 76*b* away from each other. The second spring 87 housed by the housing part 86*b* of the operation member 86 urges the arm connecting member 82 towards the projecting portion 77*b*2 of the brake arm 77*b*. Therefore, the biasing forces of the first spring 90 and the second spring 87 create and maintain a first gap 91 between the upper surface of the release arm 76*b* and the lower surface of the release arm 77*b* near the position where the first spring 90 is mounted. A second gap 92 communicating with the first gap 91 is formed between the lower surface of the projection 77b2 of the brake arm 77b and the surface of a groove 82' opposing thereto. In FIG. 5, a reference numeral 100 designates a retainer plate attached to the screw rod 101 and retaining the second spring 87, while a numeral 102 designates a spring force adusting nut screwed to the screw rod 101.

The roll release device having the construction heretofore described operates in a manner which will be explained hereinunder. FIG. 5 shows a state in which the sheet material E is clamped between the sector rolls 3 and 5. The main sector roll 3 and the subsector roll 5 are rotated counter-clockwise (D) and clockwise (D'), i.e. in the feeding directions, respectively, by a predetermined angle thereby to feed the sheet material E by a predetermined length rightwardly to a working station, as explained before in connection with FIG. 2. After the rightward feed of the sheet material E by the predetermined length, sector rolls 3 and 5 are stopped and the first oscillation shaft 16 is rotated counter-clockwise as indicated by an arrow F, so that the right-side part of the release arm 76b is moved downwardly with the aid of the force of the first spring 90. In consequence, the release arm 76b is pivotally driven clockwise around the fulcrum constituted by the release pivot shaft 78. In consequence, the sub-roll shaft 4 and the sub-sector roll 5 are moved downwardly together with the release arm 76b to move the sub-sector roll 5 away from the sheet material E, so that the sheet material E is released from the clamping force which has been exerted thereon by the sector rolls. The oscillation of the first oscillation shaft 16 causes the arm connecting member 82 to move upwardly overcoming the force of the second spring 87. During this operation, the arm connecting member 82 slides upwardly along the right end surface 76b' of the release arm 76b. In consequence, the right portion of the brake arm 77b is moved upwardly by the force of the first spring 90. As a result, the brake arm 77b is pivotally rotated counterclockwise around a fulcrum constituted by the brake pivot shaft 79 so that the movable brake pad 77b 1 is moved towards the stationary brake pad 80, thereby to clamp and fix the sheet material E between the brake pads 77b1 and 80. The counter-clockwise pivotally motion of the brake arm 77b around the brake pivot axis 79, caused by the oscillation of the first oscillation shaft 16, is not hindered by the second oscillation shaft 17 nor by the operation member 86, because the brake arm 77b is allowed to move pivotally in the counter-clockwise direction until the third gap 88, formed between the lower surface of the tabular portion 86b of the operation member 86 and the upper surface of the coupling member 85c, is completely eliminated.

After feeding the sheet material E to the right by a predetermined amount by both sector rolls 3 and 5, the first oscillation shaft 16 is rotated counter-clockwise by a predetermined amount so as to move the sub-sector roll 5 away from the main sector roll 3, thereby to release the sheet material from the clamping force exerted thereon by both sector rolls. At the same time, the sheet material E is fixed between the movable brake pad 77b1 and the stationary brake pad 80. Since the sheet material is fixed by the movable brake pad 77b1 and the stationary brake pad 80, the undesirable rightward excessive feed of the sheet material, which may otherwise be caused by the inertia after the release of the sheet material from the clamping force, is prevented to assure a high precision feed of the sheet material.

The first oscillation shaft 16 stops after the fixing of the sheet material by the brake pads 77b1 and 80. When the first oscillation shaft 16 is kept stationary, the first gap 91 between the upper surface of the release arm 76b and the lower surface of the brake arm 77b and the second gap 92 between the lower surface of the projection 77b2 of the brake arm 77b and the surface of the groove 82' opposing to the projection 77b2 are ample considerably. On the other hand, the third gap 88 formed between the lower surface of the tabular portion 86a of the operation member 86 and the upper surface of the coupling member 85c is considerably smaller than that shown in FIG. 5.

After elapse of a predetermined time after the stopping of the first oscillation shaft 16, the second oscillation shaft 17 starts to rotate in the counterclockwise direction as shown by an arrow G and the main sector roll 3 and the sub-sector roll 5 start to make clockwise and counter-clockwise rotation, respectively, substantially in synchronism with the starting of the counter-clockwise rotation of the second oscillation shaft 17. Namely, the sector rolls 3 and 5 commences rotations in the counter feeding directions. During the rotations of the sector rolls in the counter feeding directions, the sub-sector roll 5 takes the lowered position below the position shown in FIG. 5, so that the sheet material E is not moved leftward but is kept stationary. As the second oscillation shaft 17 is rotated in the aforementioned direction shown by an arrow G, the right portion of the brake arm 77b is depressed through the coupling member 85c so that the brake arm 77b is pivotally moved clockwise around the fulcrum constituted by the brakepivot axis 79, thereby to move the brake pad 77b1 downwardly to release the sheet material E from the clamping force exerted by the brake pads 77b1 and 80. During the clockwise pivotal movement of the brake arm 77b, the release arm 76b is kept stationary so that the first gap 91 and the second gap 92 are made narrower during the clockwise pivotal movement of the brake arm 77b.

As explained before, the second oscillation shaft 17 is rotated by a predetermined amount in the counter-clockwise direction as indicated by an arrow G to make the brake pads 77b1 and 80 release the sheet material E. The second oscillation shaft 17 is stopped after this release. In this state, a mechanical processing such as shearing, press work or the like is effected on the portion of the sheet material which has been fed rightward to the working position.

The rotations of both sector rolls in the counter feeding directions are continued until the processing of the above-mentioned portion of the sheet material is finished, and are caused after the completion of the same. Then, almost simultaneously with the stopping of both sector rolls, the first oscillation shaft 16 and the second oscillation shaft 17 start to rotate clockwisely. Clearly, the clockwise rotations of the first and the second oscillation shafts 16 and 17 cause the release arm 76b and the brake arm 77b to rotate around the release pivot shaft 78 and the brake pivot shaft 79 in the direction opposite to that caused by the counter-clockwise rotations of the oscillation shafts 16 and 17, i.e. in the counter-clockwise direction. Thus, the release arm 76b and the brake arm 77b are pivotally moved counter-clockwisely to resume the position shown in FIG. 5. In the state shown in FIG. 5, the sheet material E is still clamped between two sector rolls while the movable brake pad 77b1 is still kept away from the sheet material E. Thus, both sector rolls 3 and 5 are rotated in the feeding diretion to feed the sheet material to the right, followed by the cyclic operation explained hereinbefore.

In FIG. 5, only the parts associated with the brake arm 77*b* and the release arm 76*b* shown in the right part of FIG. 1 are shown, and the explanation of the construction and operation of the arms 77*b*, 76*b* and the arm actuating device 81 have been made with specific reference to FIG. 5. The brake arm 77*a* shown at the left side of FIG. 1 has a form identical to that of the brake arm 77*b* and these brake arms 77*a* and 77*b* are operatively connected to each other to make an identical action. Similarly, the release arm 76*a* shown at the left side of FIG. 1 has a form identical to the release arm 76*b* and these two release arms are operatively connected to each other to make an identical action. More specifically, the brake arms 77*a* and 77*b* are mounted at their one ends (left ends as viewed in FIG. 5) on a common brake pivot shaft 79, while the release arms 76*a* and 76*b* are carried by a common release pivot shaft 78. Each of the arm connecting member 82, first oscillation shaft 16 and the second oscillation shaft 17 shown in FIG. 5 is constituted by a single member extending in parallel with the sub-roll shaft 4 and at a right angle to the plane of FIG. 5. A projection (not shown) formed on the brake arm 77*a*, similar to the projection 77*b*2, is received by a groove 82' formed in the arm connecting member 82. The members shown in FIG. 5, such as the first spring 90, second spring 87, coupling members 85*a*, 85*b*, 85*c*, operation plate 83 and the operation member 86, are prepared in duplicate and the counterparts of these members are arranged in connection with the brake arms 77*a* and the release arm 76*a*.

As will be clearly understood from the foregoing description taken in conjunction with FIG. 5, the sector rolls 3,5, first oscillation shaft 16 and the second oscillation shaft 17 are required to make oscillation and stopping at suitable timings. Obviously, the timings oscillation and stopping of these members can be optimized by suitably selecting the factors such as the cam contours of three three-dimensional cams incorporated in the oscillation driving device 1 explained in connection with FIGS. 1 and 2.

In FIGS. 1 and 5, a reference numeral 93 designates an adjusting mechanism for optimizing the gap between two sector rolls 3 and 5 in conformity with the thickness of the sheet material E. More specifically, this adjusting mechanism 93 is constituted by the following parts: namely, a pair of parallel adjusting arms 94*a*,94*b* rotatably carried substantially at their lengthwise mid portions thereof (see FIG. 5) through bearings 105*a*,105*b* by the portions of the main roll shaft 2 extending beyond the left and right end surfaces 3*a*,3*b* of the main sector roll 3, the adjusting arms fitting at their one ends (right ends as viewed in FIG. 5) around a pivot shaft 95 rotatably carried by the housing 75 and extending substantially in parallel with the main roll shaft 2; and a screw rod rotatably carried by the shaft 98 through the needle bearing 106 and extending upwardly therefrom, the shaft 98 being connected between the other ends (left ends as viewed in FIG. 5) of the adjusting arms 94*a* and 94*b*. The screw rod 96 is provided at its upper end with a threaded portion 96*a* which extends upwardly through the wall 75*a* of the housing 75. A nut 97 is screwed to the upper end of the threaded portion 96*b* projected beyond the wall 75*a*. Therefore, the screw rod 96 is moved up and down by adjusting the nut 97 and, accordingly, the adjusting arm 94*a* and 94*b* are pivotally moved clockwise or counterclockwise around the fulcrum constituted by the pivot shaft 95. This pivotal motion of the adjusting arms 94*a* and 94*b* causes a vertical displacement of the main sector roll 3 to vary the gap between the sector rolls 3 and 5. It is thus possible to control the gap between two sector rolls 3 and 5 in relation to the thickness of the sheet material to be fed to optimize the clamping force applied to both sector rolls.

As will be clearly understood from the foregoing description, the main roll shaft 2 is moved up and down as a unit with the main sector roll 3 by the operation of the adjusting mechanism 93 shown in FIGS. 1 and 5, while the sub-roll shaft 4 is moved up and down as a unit with the sub-sector roll 5 in response to the operation of the arm actuating device 81. To this end, the main roll shaft 2 and the sub-roll shaft 4 are carried by the housing 75 for free rotation and vertical movement. More specifically, as explained before, the release pivot shaft 78 is supported at its both ends (see FIG. 1) by the housing 75 rotatably through needle bearings 108*a* and 108*b*. The release pivot shaft 78 in turn supports the sub-roll shaft 4 and, hence, the subsector roll 5 through the medium of the release arms 76*a* and 76*b*. An ample space or gap 110 is formed between the outer peripheral surface of the left end portion (see FIG. 1) of the sub-roll shaft 4 extending through the housing 75 and the inner peripheral surface of the bore in the housing 75 through which the above-mentioned end portion of the sub-roll shaft 4 is extended. It will be seen that this supporting construction permits the sub-roll shaft 4 to rotate and move up and down.

Although not shown in FIG. 1, the shaft 95 shown in FIG. 1 extends in parallel with the main roll shaft 2 and is supported at its both ends by the housing 75 through needle bearings as in the case of the release pivot shaft 78. This shaft 95 supports, through the adjusting arms 94*a*,94*b*, the main roll shaft 2 and, hence, the main center roll 3. An ample space or gap is preserved between the left end portion (see FIG. 1) of the main roll shaft 2 and the bore in the housing 75 receiving the left end of the main roll shaft 2. Therefore, the main roll 2 also is rotatable and movable up and down within the housing 75.

As will be understood from the foregoing description, the roll feed apparatus of the invention is constructed to intermittently feed in one direction the sheet material clamped between the main sector roll and the sub-sector roll thereby to successively move the sheet material to different working positions. This roll feed apparatus has the following characteristic features. Namely, a main sector roll 3 and a sub-sector roll 5 having sector-shaped cross-section are used as feed rolls in place of the conventionally used rolls having a circular cross-section. In addition, the main sector roll 3 is oscillatorily driven by the oscillation driving device 1 without any gear transmission therebetween, while the sub-sector roll 5 is drivingly connected to the main sector roll 3 through a specific driving connection device 6 in such a manner that it is driven in the direction opposite to the direction of rotation of the main sector roll 3 substantially by the same angle as the angle of rotation of the main sector roll 3.

These structural features in combination offers the following advantages. Namely, since the weights or mass of the feed rolls are reduced thanks to the use of sector-shaped rolls, the force of inertia generated during the operation of the rolls is decreased to ensure a higher precision of feed of the sheet material in the high speed operation of the feed apparatus as compared with the conventional apparatus incorporating feed rolls having circular cross-sections. In addition, the elimination of gear transmission between the oscillation driving device 1 and the main center roll 3 considerably simplifies the construction of the roll feed apparatus to reduce the weight of the same, while obviating any reduction of the precision of feed of the sheet material attributable to backlash which is inevitable when a gear transmission is used. Furthermore, the driving connection device 6 can drive the main sector roll 3 and the sub-sector roll 5 in relation to each other without fail, even when the angle (see FIG. 3) formed between the first and second links 12 and 13 and the plane including the path A of the sheet material is changed by a change in the distance between two sector rolls 3 and 5. It is, therefore, possible to simplify the construction of the roll release device 7 which operates to cause a relative movement between two sector rolls such that, when the sector rolls are rotated in the feeding direction, they clamp and feed the sheet material but releases the same when they are rotated in the counter feeding direction. In addition, the simplification of the construction is attained also in the mechanism for adjusting the gap between both sector rolls 3 and 5 in conformity with the thickness of the sheet material, i.e. the mechanism 93 explained in connection with FIG. 5.

Furthermore, by providing the oscillation driving device 1 with an oscillation angle changing device 15 (see FIGS. 2 and 3), it is possible to vary the oscillation angle of the sector rolls 3,5 even during the operation of the roll feed aparatus, so that the length or amount of feed of the sheet material per cycle of feeding operation can be varied without substantial difficulty.

In the described embodiment, the roll release device is constituted by the following parts: namely, a pair of release arms carried substantially at the lengthwise mid portions thereof by the portions of the sub-roll shaft extending beyond the axial ends of the sub-sector roll and fitting at their one ends on the release pivot shaft; a pair of brake arms disposed between respective release arms and the path of feed of the sheet material and having one ends adjacent to the above-mentioned one ends of the release arms fitted around the brake pivot shaft; and an arm actuating device operatively connected to the other ends of the release arms and the other ends of the brake arms. In operation, the arm actuating device is driven by the oscillation driving device to cause pivotal motions of the pair of release arms and the pair of brake arms at a suitable timing. According to this arrangement, it is possible to effect the clamping of the sheet material by the sector rolls when the latter are rotated in the feeding directions, as well as unclamping of the same when the sector rolls are rotated in the counter feeding direction, and further a temporary fixing of the sheet material after unclamping so as to prevent the excessive feed of the sheet material by the force of inertia. Namely, according to the invention, quite a simple construction is offered in which, by pivotal motions of a pair of release arms and a pair of brake arms at suitable timings, the sector rolls are moved towards and away from each other to clamp and unclamp the sheet material, as well as the temporary fixing and release of the same. This arrangement, therefore, makes it possible to produce a less expensive roll feed apparatus having high precision of feeding in the high-speed operation.

Although the invention has been described through specific terms, it is to be noted here that the described embodiment is not exclusive and various changes and modifications may be imparted thereto without departing from the scope of the invention which is limited solely by the appended claims.

What is claimed is:

1. A roll feed apparatus comprising:

an oscillation driving device;

a main sector roll integrally carried by a main roll shaft and adapted to be oscillatorily driven by said oscillation driving device;

a sub-sector roll integrally carried by a sub-roll shaft extending parallel to said main roll shaft, said sub-sector roll being adapted to cooperate with said main sector roll so as to clamp a sheet material therebetween and feed the same along a planar path of feed;

a driving connection mechanism for drivingly connecting said main sector roll and said sub-sector roll to each other in such a manner that, when said main sector roll is rotated in one direction by a predetermined angle, said sub-sector roll is rotated in the opposite direction substantially by the same angle as said main sector roll; and a roll release device adapted to cause a relative movement between said main sector roll and said sub-sector roll away from each other when said sector rolls are rotated in the directions opposite to those for feeding said sheet material thereby to release said sheet material from the clamping force exerted by said sector rolls;

wherein said driving connection mechanism includes a first oscillation arm mounted on a portion of said main roll shaft extending outside of said main sector roll, a second oscillation arm mounted on a portion of said sub-roll shaft extending outside of said sub-sector roll and positioned substantially in the same plane as said first oscillation arm, a guide member disposed near the point of intersection between said plane and the path of feed of said sheet material and provided with a guide groove extending in the direction of feed of said sheet material, a sliding member slidably disposed in said guide groove, and a first link and a second link connecting said sliding member to said first and second oscillation arms, respectively, said first and second links being arranged substantially in symmetry with each other with respect to the plane of said feed path of said sheet material at such an inclination to said feed path plane as to form a V-shape having an apex located at the position of said sliding member and such that said movement between said main sector roll and said sub-sector roll away from each other and a return movement between said main sector roll and said sub-sector roll toward each other causes corresponding changes in said inclination of said first and second links relative to said feed path plane, and said second oscillation arm being adapted to be oscillatorily driven by said first oscillation arm through said sliding member and said first and second links even when said inclination changes because of said movements between said main sector roll and said sub-sector roll.

2. A roll feed apparatus according to claim 1, wherein said oscillation driving device includes: an oscillation member adapted to be driven for an oscillatory motion around a fixed axis; a slider attached to said oscillation member for oscillation as a unit with the oscillation member but slidable in the axial direction of said oscillation member; and an oscillation angle changing device having a connecting rod connected between said slider and said first oscillation arm; whereby the angle of oscillation of said main sector roll with respect to the angle of oscillation of said oscillation member is adjusted through adjustment of the position of said slider in the axial direction of said oscillation member.

3. A roll feed apparatus according to claim 1, wherein said roll release device includes: a pair of release arms carried substantially at the lengthwise mid-portion thereof by portions of said sub-roll shaft extending beyond both axial end surfaces of said sub-sector roll and each fitted at one end on a release pivot shaft extending from a housing of said apparatus in parallel with said sub-roll shaft; a pair of brake arms disposed between respective release arms and the path of feed of said sheet material and each having one end adjacent to one of said pivot shaft ends of said release arms fitted on a brake pivot shaft extending from said housing substantially in parallel with said sub-roll shaft, said brake arms being provided with movable brake pads extending therefrom towards said path of feed of said sheet material; stationary brake pads opposed to said movable brake pads across said sheet material; and an arm actuating device operatively connected to the other ends of said pair of release arms and the other ends of said pair of brake arms and adapted to be driven by said oscillation driving device; wherein said arm actuating device is adapted to cause pivotal motions of said pair of release arms and said pair of brake arms in such a manner that, when said sector rolls are rotated in the direction for feeding said sheet material, said sub-sector roll is moved towards said main sector roll while said movable brake pads are kept away from said stationary brake pads; and wherein, when said sector rolls are rotated in the direction opposite to the direction for feeding said sheet material, said sub-sector roll is moved away from said main sector roll while said movable brake pads are temporarily moved toward said stationary brake pads.

4. A roll feed apparatus according to claim 3, wherein said arm actuating device includes: an arm connecting member having a groove loosely receiving projections on said other ends of said pair of brake arms, said arm connecting member slidably engaging said other ends of said pair of release arms; a first oscillation shaft adapted to be oscillatorily driven by said oscillation driving device at a predetermined timing and operatively connected through couplings to said pair of release arms and to said arm connecting member; a second oscillation shaft adapted to be driven at a predetermined timing by said oscillation driving device and operatively connected through couplings to said pair of brake arms; a first spring biasing said pair of release arms and said pair of brake arms away from each other to form a first gap therebetween; and a second spring biasing said arm connecting member towards said projections of said pair of brake arms and cooperating with said first spring in forming a second gap communicating with said first gap, said second gap being formed between said projections on said brake arms and the wall of said groove in said arm connecting member adjacent to said first gap; wherein, when said first oscillation shaft is rotated in one direction, said arm connecting member is slid towards the path of feed of said sheet material overcoming the force of said second spring while said pair of release arms cause a pivotal movement of said sub-sector roll away from said main sector roll with the aid of the force of said first spring and said pair of brake arms make pivotal movement to move said movable brake pads towards said stationary braking pads; and wherein, when said second oscillation shaft is thereafter rotated in one direction, said pair of brake arms are pivotally moved in such a direction as to reduce said first and second gaps thereby to move said movable brake pads away from said stationary brake pads.

5. A roll feed apparatus according to claim 3, wherein said oscillation driving device includes an oscillation angle changing device having an oscillation member adapted to be driven for an oscillation around a fixed axis, a slider secured to said oscillation member and slidable on said oscillation member in the axial direction of the latter, and a connecting rod for connecting said slider to said first oscillation arm, whereby the oscillation angle of said main sector roll with respect to the oscillation angle of said oscillation member is adjusted through the control of the amount of sliding movement of said slider in the axial direction of said oscillation member.

6. A roll feed apparatus according to claim 1 which further includes means for moving said main sector roll and said sub-sector roll toward and away from each other to adjust a distance between said two sector rolls forming a gap in which said sheet material is clamped between said two sector rolls so as to feed the same along said planar feed path, said adjusting movement between said main sector roll and said sub-sector roll causing a corresponding change in said inclination of said first and said second links relative to said feed path plane, and in which said second oscillation arm is adapted to be oscillatorily driven by said first oscillation arm through said sliding member and said first and second links even when said inclination is changed by said adjusting movement between said main sector roll and said sub-sector roll.

7. A roll feed apparatus comprising:

an oscillation driving device;

a main sector roll integrally carried by a main roll shaft and adapted to be oscillatorily driven by said oscillation driving device;

a sub-sector roll integrally carried by a sub-roll shaft extending parallel to said main roll shaft, said sub-sector roll being adapted to cooperate with said main sector roll so as to clamp a sheet material therebetween and feed the same along a planar path of feed;

a driving connection mechanism for drivingly connecting said main sector roll and said sub-sector roll to each other in such a manner that, when said main sector roll is rotated in one direction by a predetermined angle, said sub-sector roll is rotated in the opposite direction substantially by the same angle as said main sector roll; and a roll release device adapted to cause a relative movement between said main sector roll and said sub-sector roll away from each other when said sector rolls are rotated in the directions opposite to those for feeding said sheet material thereby to release said sheet material from the clamping force exerted by said sector rolls;

wherein said roll release device includes a pair of release arms carried substantially at the lengthwise mid-portion thereof by portions of said sub-roll shaft extending beyond both axial end surfaces of said sub-sector roll and each fitted at one end on a release pivot shaft extending from a housing of said apparatus in parallel with said sub-roll shaft, a pair of brake arms disposed between respective release arms and the path of feed of said sheet material and each having one end adjacent to one of said pivot shaft ends of said release arms fitted on a brake pivot shaft extending from said housing substantially in parallel with said sub-roll shaft, said brake arms being provided with movable brake pads extending therefrom towards said path of feed of said sheet material, stationary brake pads opposed to said movable brake pads across said sheet material, and an arm actuating device operatively connected to the other ends of sdid pair of release arms and the other ends of said pair of brake arms and adapted to be driven by said oscillation driving device;

wherein said arm actuating device is adapted to cause pivotal motions of said pair of release arms and said pair of brake arms in such a manner that, when said sector rolls are rotated in the direction for feeding said sheet material, said sub-sector roll is moved towards said main sector roll while said movable brake pads are kept away from said stationary brake pads;

wherein, when said sector rolls are rotated in a direction opposite to the direction for feeding said sheet material, said sub-sector roll is moved away from said main sector roll and, while the sub-sector roll is in a position away from the main sector roll, said movable brake pads are temporarily moved toward said stationary brake pads and then moved away from the latter;

wherein said arm actuating device includes an arm connecting member having a groove loosely receiving projections on said other ends of said pair of brake arms, said arm connecting member slidably engaging said other ends of said pair of release arms, a first oscillation shaft adapted to be oscillatorily driven by said oscillation driving device at a predetermined timing and operatively connected through couplings to said pair of release arms and to said arm connecting member, a second oscillation shaft adapted to be driven at a predetermined timing by said oscillation driving device and operatively connected through couplings to said pair of brake arms, a first spring biasing said pair of release arms and said pair of brake arms away from each other to form a first gap therebetween, and a second spring biasing said arm connecting member towards said projections of said pair of brake arms and cooperating with said first spring in forming a second gap communicating with said first gap, said second gap being formed between said projections on said brake arms and the wall of said groove in said arm connecting member adjacent to said first gap;

wherein when said first oscillation shaft is rotated in one direction, said arm connecting member is slid towards the path of feed of said sheet material overcoming the force of said second spring while said pair of release arms cause a pivotal movement of said sub-sector roll away from said main sector roll with the aid of the force of said first spring and said pair of brake arms make pivotal movement to move said movable brake pads towards said stationary braking pads; and, wherein, when said second oscillation shaft is thereafter rotated in one direction, said pair of brake arms are pivotally moved in such a direction as to induce said first and second gaps thereby to move said movable brake pads away from said stationary brake pads.

8. A roll feed apparatus according to claim 7, wherein said oscillation driving device includes: an oscillation member adapted to be driven for an oscillatory motion around a fixed axis; a slider attached to said oscillation member for oscillation as a unit with the oscillation member but slidable in the axial direction of said oscillation member; and an oscillation angle changing device having a rod connected between said slider and said first oscillation arm so that the angle of oscillation of said main sector roll with respect to the angle of oscillation of said oscillation member is adjusted through adjustment of the position of said slider in the axial direction of said oscillations member.

9. A roll feed apparatus according to claim 7, wherein said oscillation driving device includes an oscillation angle changing device having an oscillation member adapted to be driven for an oscillation around a fixed axis, a slider secured to said oscillation member and slidable on said oscillation member in the axial direction of the latter, and a connecting rod for connecting said slider to said first oscillation arm so that the oscillation angle of said main sector roll with respect to the oscillation angle of said oscillation member is adjusted through control of the amount of sliding movement of said slider in the axial direction of said oscillation member.

* * * * *